United States Patent [19]

Heimala et al.

[11] 4,284,665

[45] Aug. 18, 1981

[54] PROCESS FOR COATING AN ELECTRICALLY NONCONDUCTIVE MATERIAL WITH METAL

[75] Inventors: Seppo O. Heimala, Pori; Frans H. Tuovinen, Ulvila, both of Finland

[73] Assignee: Outokumpu Oy, Helsinki, Finland

[21] Appl. No.: 105,555

[22] Filed: Dec. 20, 1979

[30] Foreign Application Priority Data

Dec. 20, 1978 [FI] Finland ..... 783935

[51] Int. Cl.[3] ..... C23C 3/02

[52] U.S. Cl. ..... 427/203; 427/205; 427/404; 427/427

[58] Field of Search ..... 427/203, 205, 426, 427, 427/168, 304, 305, 306, 404

[56] References Cited

U.S. PATENT DOCUMENTS

| | | | |
|---|---|---|---|
| 99,806 | 2/1870 | Adams | 427/203 |
| 2,351,940 | 6/1944 | Dupuis | 427/404 |
| 2,690,401 | 9/1954 | Gutzeit et al. | 427/290 |
| 2,748,023 | 5/1956 | Meth | 427/168 |
| 3,084,063 | 4/1963 | Barnes et al. | 427/427 |
| 3,226,256 | 12/1965 | Schneble et al. | 427/306 |

FOREIGN PATENT DOCUMENTS

| | | | |
|---|---|---|---|
| 571183 | 8/1945 | United Kingdom | 427/205 |

*Primary Examiner*—Ralph S. Kendall

*Attorney, Agent, or Firm*—Brooks, Haidt, Haffner & Delahunty

[57] ABSTRACT

A process for coating an electrically nonconductive material with a metal by attaching a less noble metal or a compound thereof, in pulverous form, to the surface of the electrically nonconductive material and spraying a solution of the nobler metal on the surface thus coated in order to cause the nobler metal to adhere to the surface.

7 Claims, No Drawings

PROCESS FOR COATING AN ELECTRICALLY NONCONDUCTIVE MATERIAL WITH METAL

BACKGROUND OF THE INVENTION

The present invention relates to a process for coating an electrically nonconductive material with metal by attaching a pulverous metal or metal compound to the surface of the electrically nonconductive material. This invention relates in particular to a process for coating building boards, such as asbestos, fiberboard, plastic and wood, with an even and thin metal layer.

It is often necessary to attach a thin metal layer to the surface of some other material. It is previously known to cement nuclei consisting of palladium on the surface of an electrically nonconductive material in order to activate the said surface so that it can subsequently be coated with another metal. It is also known to cement some electrically conductive substance, such as carbon powder, on the surface of an electrically nonconductive material, whereafter the coating can be carried out electrolytically.

The above processes are not, however, usable if the material to be coated contains a substance which reacts like a base, for example magnesium oxide or calcium oxide. In an electrolysis, these basic-reacting substances produce a hydroxide layer on top of the powder, this layer then serving as an insulation. One possibility suggested is to glue a thin metal layer to the surface of the material to be coated. Glueing has, however, proven to be difficult if the metal layer to be glued is very smooth. If the surface of the metal layer is roughened electrolytically, for example, the process becomes complicated and expensive.

The object of the present invention is to provide a process for coating an electrically nonconductive material with metal, the process eliminating the above difficulties.

SUMMARY OF THE INVENTION

The present invention provides a process according to which a solution of a nobler metal is sprayed on the surface of an electrically nonconductive material, with a less noble metal or its compound, in pulverous form, having been attached to the surface in advance. The less noble metal or its compound can, of course, be thoroughly mixed with the electrically nonconductive material; the main point is that the pulverous metal or metal compound is also present in the surface layer to be coated. When a solution of the nobler metal is sprayed on the surface of such a nonconductive material, the nobler metal precipitates out from the solution and attaches to the said surface as an even and thin layer.

DESCRIPTION OF THE PREFERRED EMBODIMENTS

According to the present invention, a metal powder is mixed in the surface of the material to be coated. The metal powder to be attached to the surface of the nonconductive material should precede in the voltage series the metal which is to be used for the coating. If the invention is to coat a nonconductive material with copper or nickel, pulverous zinc or iron is first attached to the surface of the electrically nonconductive material. Thereafter, a solution containing copper or nickel is sprayed on the surface of the electrically nonconductive material. When the solution comes in contact with the powder attached to the surface of the nonconductive material, an electric couple is formed. In this case, the pulverous metal or metal compound partly dissolves and passes into the solution, whereas the nobler metal in the solution cements on the surface of the material to be coated. The powder need not necessarily cover the entire surface, since the nobler metal attaches not only to points right next to the powder particles but also further away from them, because of solution flow. The process according to the invention provides a highly adhesive metal layer on the surface of an electrically nonconductive material.

If the electrically nonconductive material is in particle form at some stage, it is easy to mix a pulverous metal or metal compound with it. If, however, the material to be coated is wood or plastic board, its surface must first be softened in order to attach the pulverous metal or metal compound to it. The softening can be achieved by heating or with the aid of various chemicals. It is evident that this softening treatment can also to some extent be replaced by a mechanical treatment.

The coating of an electrically nonconductive material with a pulverous metal or metal compound is preferably carried out so that first a discontinuous layer of a coarser metal powder, with a particle size of approx. 50–500 $\mu$m, is spread on the nonconductive material. The powder can be spread in pure form or as a mixture with the material to be coated. After this, one or more layers of a finer metal powder, with a particle size in the order of 1–50 $\mu$m, is spread on top of this layer. The optimum particle size of the powder is primarily determined by the type of surface desired, the item to be coated and the reactivity of the powder. If a highly glossy metal surface is desired, known substances which increase glossiness are added to the solution of the nobler metal. By using a coarser powder beneath the finer powder, an advantage is gained in that, when the solution is sprayed, the adhesive strength and the corrosion resistance of the coating are easier to control. By regulating the cementation conditions and its duration, the desired portion of the non-noble metal can be caused to remain undissolved and thereby the adhesion and the electrochemical corrosion resistance can be controlled. This also provides a cathodic protection against corrosion.

As said above, part of the pulverous metal or metal compound attached to the surface of the electrically nonconductive material dissolves when a solution of a nobler metal is sprayed on the surface coated by this method. The less noble metal can, however, be regenerated in various ways, depending on the base of the solution. If the powder used is zinc and the solution is chloride-based, the zinc can be regenerated by extraction. If, on the other hand, the solution is sulfate-based, it can be recovered by electrolysis. The solution can also be organic, and even from organic solution the zinc can be regenerated by extraction, for example.

The nobler metal to be coated can be, for example, copper+, copper++, nickel++, cobalt or aluminum. The less noble metal used can be zinc or iron, or also an earth alkali metal.

The invention is described below in more detail with the aid of examples.

EXAMPLE 1

Water is added to a mixture of cement powder and asbestos fiber. Zinc powder is added at the filtration stage, either to the first or the last filtration stage, so that the powder is left either on the lower or the upper tray, and thereafter the pulp is pressed into boards. A copper sulfate solution is sprayed on the completed boards, the solution having a copper concentration of 20 g/l and a pH of less than 2.5. The spraying is performed at a pressure of 0.5 bar, using nozzles with a diameter of 1.7 mm. By this procedure a tightly adhering copper film is obtained on the board surface, and the zinc which has passed into the solution is recovered by electrolysis.

EXAMPLE 2

Iron powder is added to plastic which is in molten state, in which case the powder sinks to the bottom by gravity and remains on the lower surface of the plastic board. Alternatively, the iron powder is added to plastic which is in plastic state. In this case, the powder is added to the upper surface before rolling, and the powder to some extent penetrates the plastic board during rolling.

Thereafter, the plastic board thus pre-treated is sprayed with a solution having a copper concentration of 100 g/l and a pH less than 2.5, and which also contains solid iron oxyhydroxide at approx. 50 g/l. With the aid of the solid material the diffusion layer on the surface can be made smaller and thus the surface more glossy.

EXAMPLE 3

Zinc powder is mixed with a cellulose fiber suspension, and during the compressing stage the powder adheres to the board produced and is present in it partly immersed in the glue. Thereafter, a nickel electrolyte solution with a pH of over 1.5 is sprayed on the surface of the board. By this procedure, a nickel metal layer can be formed on the surface of a board made of wood pulp.

A metal powder such as zinc powder is generally used only to such an extent as is necessary for securing good adhesion. If there is an excess of zinc powder, the pH in the solution changes so much during the coating that the remainder of the metal cementing on the surface is cemented as an oxide. By this procedure, the desired color effect can be obtained.

What is claimed is:

1. A process for coating an electrically nonconductive material with a metal, comprising impregnating the surface of the nonconductive material with a metal or compound thereof in pulverous form less noble than the metal used for coating the surface of the nonconductive material, by first applying a coarser powder of said less noble metal or compound having a particle size of approximately 50–500 μm and then, on the surface, applying a finer powder of said less noble metal or compound having a particle size of 1–50 μm, and finally spraying a solution of the nobler metal on the surface of the electrically nonconductive material.

2. The process of claim 1, in which the solution of the nobler metal is sprayed at a pressure of 0.5–3 bar by nozzles with a diameter of 1.7–3.0 mm.

3. The process of claim 1 or 2, in which the pH of the solution of the nobler metal is over 1.5.

4. The process of claim 1 or 2, comprising spraying a solution having a copper concentration of 20–100 g/l.

5. The process of claim 1, comprising attaching the powder to the surface of the electrically nonconductive material at a rate of 200 g–2 Kg/m$^2$.

6. The process of claim 1, in which the solution is sprayed on the said surface at a velocity of 0.5–50 m/s.

7. The process of claim 1, in which the size of the drops of solution in the spray is 10–3000 μm.

* * * * *